US008445547B2

(12) United States Patent
Jorgensen et al.

(10) Patent No.: US 8,445,547 B2
(45) Date of Patent: May 21, 2013

(54) MEANS OF PROCESSING FUEL GRADE PETROLEUM COKE FOR USE IN INTERNAL COMBUSTION ENGINES

(76) Inventors: Alfred Jorgensen, Las Vegas, NV (US); Roger J. Swenson, Salt Lake City, UT (US)

( * ) Notice: Subject to any disclaimer, the term of this patent is extended or adjusted under 35 U.S.C. 154(b) by 953 days.

(21) Appl. No.: 12/539,591

(22) Filed: Aug. 11, 2009

(65) Prior Publication Data

US 2010/0031908 A1 Feb. 11, 2010

Related U.S. Application Data

(60) Provisional application No. 61/087,898, filed on Aug. 11, 2008.

(51) Int. Cl.
*F02B 75/00* (2006.01)

(52) U.S. Cl.
USPC ..... 516/31; 516/32; 516/38; 44/280; 44/281; 44/282; 201/10; 201/17; 208/131; 208/132

(58) Field of Classification Search
USPC ..... 201/10, 17; 208/131–132
See application file for complete search history.

(56) References Cited

U.S. PATENT DOCUMENTS 4,547,200 A * 10/1985 Shinohara et al. ..... 44/280

OTHER PUBLICATIONS

Pereira, C.J. et al. (2008). "Section 19: Reactors," in Perry's Chemical Engineers' Handbook, 8th ed., McGraw-Hil.*

* cited by examiner

*Primary Examiner* — Brian McCaig
(74) *Attorney, Agent, or Firm* — Steven Rinehart

(57) ABSTRACT

Liquefied petroleum coke (LPC) comprises diesel engine fuel grade petroleum coke that is produced by subjecting crude oil refinery feedstock to de-salting, coking, micronization, de-ashing, and slurrification processes to reduce impurities such as metallic components and make the LPC suitable for use in internal combustion engines, such as diesel engine systems.

19 Claims, 6 Drawing Sheets

MEANS OF PROCESSING FUEL GRADE PETROLEUM COKE FOR USE IN INTERNAL COMBUSTION ENGINES

CROSS-REFERENCES TO RELATED APPLICATION

This application is a continuation-in-part of, and claims priority to, U.S. Provisional Patent Application No. 61/087,898 entitled "Production of Diesel Engine Fuel Grade Petroleum Coke" and filed on Aug. 11, 2008 for Roger J. Swenson and Alfred Z. Jorgensen, which is incorporated herein by reference.

BACKGROUND OF THE INVENTION

1. Field of the Invention

The present invention relates generally to the field of petroleum coking processes. More specifically, the present invention relates to modifications of petroleum coking processes for the production of a form of petroleum coke that has characteristics that will allow it to be used as a diesel engine fuel. This invention also relates generally to the use of this new formulation of petroleum coke for the production of energy in diesel engine generation systems that typically use liquid or gaseous hydrocarbon fuels.

2. Description of the Related Art

Petroleum coke is a carbonaceous solid produced by the coker unit in crude oil refineries after crude oil has been subjected to a fractional distillation process. As shown in Prior Art FIG. 1, crude oil is separated into fractions through fractional distillation, in which petroleum fractions with lower boiling points, such as kerosene and diesel oil, are separated out from heavier fractions, such as asphalt and petroleum coke. Heavier sour crude oil supplies now entering the market are increasing the amount of heavy residuals available for processing into petroleum coke.

Thermal cracking processes were developed to convert as much of the heavy crude oil fractions into lighter products as possible. These refinery processes evolved into the modern coking processes that are currently used to upgrade the heavy residuals remaining after removing the lighter products from the crude oil refinery feedstock.

Modern coking processes employ thermal decomposition (or "cracking") to maximize the conversion of low-value heavy residuals to lower boiling point hydrocarbon products. Coker feedstocks typically consist of non-volatile, asphaltic and aromatic materials with "theoretical" boiling points exceeding 1000° F. at atmospheric pressure. The boiling points are "theoretical" because these materials coke or crack from thermal decomposition before they reach such temperatures.

Coking feedstocks of heavy residuals normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum vacuum distillation residuum, catalytic cracker residual oils, hydrocracker residual oils, and residual oils from other refinery units.

Consequently, coking feedstocks vary substantially among refineries. Their composition and quantity primarily depend on (1) the crude oil feedstock, (2) refinery processing equipment, and (3) the optimized operation plan for any particular refinery. In addition, contaminant compounds, which occur naturally in the crude oil, generally have relatively high boiling points and relatively complex molecular structures. Many of the materials or byproducts in the refinery become coke feedstock, and their contaminants usually end up in the petroleum coke by-product.

There are three major types of modern coking processes currently used in refineries to convert the heavy crude oil fractions into lighter hydrocarbons and petroleum coke: Delayed Coking, Fluid Coking, and Flexicoking. In all three of these coking processes, the petroleum coke is considered a by-product that is tolerated in the interest of more complete conversion of refinery residues to lighter hydrocarbon compounds. These lighter hydrocarbon compounds range from pentanes to complex hydrocarbons with boiling ranges typically between 350 and 950° F. The heavier cracked liquids (e.g. gas oils) are commonly used as feedstocks for further refinery processing that transforms them into transportation fuel blend stocks. A petroleum coke known as shot coke can also be created in the coking process described above.

Coking processes have been improved over time with improvements related to increasing the yield and recovery of cracked liquids and decreasing the coke yield. The content of volatile material in the resulting petroleum coke has been continually decreased, where possible. Various patents disclose improvements to the delayed coking process that include, but are not limited to, (1) coker designs that reduce drum pressures, (2) coker designs to provide virtually no recycle, and (3) periodic onstream spalling of heaters to increase firing capabilities and run length at higher heater outlet temperatures. These technology advances have been implemented in an effort to maximize the cracked liquid yields of the delayed coke and reduce petroleum coke yields and volatile content.

Other modifications of these coking processes introduce various wastes for disposal. Several patents disclose various means to inject certain types of oily sludges. Other prior art uses these coking processes for the disposal of used lubricating oils. Additional patents disclose the use of these coking processes for the disposal of other wastes. In general, these patents discuss the potential limited impact on the coke yield and volatile content, and promote other means to negate any increases. Also, these waste disposal techniques often increase the ash content of the coke and can introduce additional, undesirable impurities, such as sodium. Consequently, the objectives of these patents are to reuse or dispose of these wastes rather than enhance the petroleum coke properties.

U.S. Pat. No. 6,168,709 teaches the process to reduce specific contaminants in the petroleum coke order to increase the volatile composition of the pet coke for use in boiler systems and other systems discussed specifically as a replacement fuel for solid fuels such as coal.

U.S. Pat. No. 4,481,101 describes a method for further refining coker feedstock to remove metals and other contaminants from petroleum coke.

Various combustion technologies have been developed to overcome the combustion issues in petroleum coke. Specially designed combustion systems (noted above) include fluidized bed combustion, pyrolysis/gasification systems, and low heat capacity furnaces (i.e. without heat absorption surfaces). In general, these systems are cumbersome, expensive, and can require very large obtrusive structures. Several patents also disclose technologies to grind and stabilize coke/oil mixtures for use in conventional combustion systems. However, the quality of the traditional petroleum coke used in these fuel mixtures normally limits (1) the particle size distribution of the solids and (2) the degree of combustion (i.e. carbon burnout). The prior art has not addressed the specific combustion issues associated with producing petroleum coke with specific requirements for use in diesel engine systems.

Diesel engine systems have requirements for low levels of contaminants that form abrasive ashes such as aluminum and silicon to the degree that the combination of such metals are not greater then 80 ppm by weight in the liquid fuel prior to centrifugal separators reducing these impurities to an acceptable level. Petroleum cokes have impurities including sulfur and heavy metals (silicon, aluminum, vanadium, etc.).

SUMMARY

From the foregoing discussion, it should be apparent that a need exists for a means of removing contaminants from petroleum coke. Beneficially, such a means would process petroleum coke such that it is usable for some of the same applications that are lighter hydrocarbons, including powering internal combustion engines.

The present invention has been developed in response to the present state of the art, and in particular, in response to the problems and needs in the art that have not yet been fully solved by currently available inventions. Accordingly, the present invention has been developed to provide a means of processing petroleum coke for use in internal combustion engines that overcomes many or all of the above-discussed shortcomings in the art.

It is an object of the present invention to provide a fuel grade petroleum coke based fuel that is able to (1) achieve acceptable combustion characteristics in internal combustion engine systems, (2) sufficiently reduce the abrasive impurities such as ashes to levels that are not harmful to the engine system, and (3) utilize existing crude oil desalting processes to eliminate contaminants prior to coking or post coke production cleaning systems that are available to enable economic production of coke acceptable as a fuel for internal combustion engines.

The present invention successfully addresses the problems associated with traditional petroleum coke as fuel for internal combustion engines. This invention provides the following features:

(1) Modifications in the crude oil desalting process that conditions crude oil by removing the contaminants aluminum and silicon to acceptable levels prior to the crude oil refining process and or prior to the coking process if required, and the micronization of such processed petroleum coke such that said fuel grade petroleum coke can be provided to the fuel delivery system of a diesel engine.

(2) A process that reduces quantities of certain metal contaminants to acceptable levels in the fuel grade petroleum coke after the petroleum coke has been produced in a coking process and the micronization of such petroleum coke and production of a slurry with said micronized petroleum coke using well know commercially available slurry processes. Such processes would produce a petroleum coke product that would be capable of use in a diesel engine. These and other aspects of the present invention are realized in a method and system for producing petroleum coke based fuels as shown and described in the following figures and related description.

A method of producing liquefied petroleum coke (LPC) from fuel grade petroleum coke is provided, the steps of the method comprise de-ashing the fuel grade petroleum coke to reduce its silicon and aluminum content; micronizing the petroleum coke such that its particles average less than 20 microns in size; and slurrifying the petroleum coke to comprises a micro-fluid with an apparent Newtonian fluid viscosity of between 10 and 20 centiStrokes.

Various embodiments of the method also comprise a step of de-salting the unit of crude oil using de-salting units in series such that the de-saltation process reduces the prevalence of one or more heavy metals in the unit of crude oil; and may further comprise a step of further reducing the prevalence of heavy metals in the various coker feed-streams by using one or more of centrifugal separating units and de-salting units capable of tolerating temperatures in excess of 250 degrees Fahrenheit.

Other embodiment of the method comprise a step wherein the de-ashing step takes place after the crude oil refining step but before the coking process and reduces the sulfur and aluminum content of the coker feed-steam such that the resulting fuel grade petroleum coke produced comprises less than 80 parts per million of aluminum and silicon combined.

In still further embodiments of the present invention, the de-ashing step takes place after the crude oil refining step but before the coking process and reduces the sulfur and aluminum content of the coker feed-steam such that the resulting fuel grade petroleum coke produced comprises less than 18 parts per million of aluminum and silicon combined, while in other embodiments the de-ashing step takes place after the coking step and reduces the sulfur and aluminum content of the fuel grade petroleum coke such that the fuel grade petroleum coke comprises less than 80 parts per million of aluminum and silicon combined.

The de-ashing step may also take place after the coking step to reduce the sulfur and aluminum content of the fuel grade petroleum coke such that the fuel grade petroleum coke comprises less than 18 parts per million of aluminum and silicon combined. The fuel grade petroleum coke may also be micronized to an average particle size of 20 microns or less, or to an average particle size of between 2 and 5 microns, or even to a particle size of less than 2 microns.

The fuel grade petroleum coke may be subjected to subsequent de-ashing steps in response to the measured amounts of aluminum and silicon in the petroleum coke exceeding a predetermined criterion.

The method of Claim 1, wherein the average diameter of a particle of the fuel grade petroleum coke is measured after micronization and the fuel grade petroleum coke is re-micronized if it is found to have an average particle size that exceeds a predetermined criterion.

The method according to Claim 11 or Claim 12, wherein a computer automatically calculates the predetermined criterion by analyzing historical data comprising one or more of horsepower output measurements for a specific set of one or more internal combustion engines running on LPC, fuel efficiency ratings for the specific set of internal combustion engines running on LPC, usable lifespan of the specific set of internal combustion engines running on LPC, the amount of impurities in LPC running on the specific set of internal combustion engines, and the average particle sizes of LPC running the specific set of internal combustion engines.

The slurrifying step may further comprise combining the micronized fuel grade petroleum coke with water and one or more of water, soda, coal dust, alkylesters of orthophosphoric acid, phosphate ester, and alcohol to produce a petroleum coke slurry.

Another method is provided which incorporates the previous embodiments of the earlier method and further comprising a step of using the liquefied petroleum coke (LPC) as a fuel in an engine selected from the group consisting of two-stroke low-speed diesel engines with an RPM range of between 95 and 250 revolutions per minute, four-stroke medium-speed diesel engines with an RPM range of between 250 and 950 revolutions per minute, and stationary gas turbines.

A liquefied petroleum coke (LPC) product is provided as made in accordance with the first method, and another LPC product is provided in which the LPC comprises an aluminum and silicon content of less than 80 parts per million combined; and an average particle size of less than 20 microns.

The LPC product may, in some embodiments, further comprise an aluminum and silicon content of less than 18 parts per million by weight combined; an average particle size of less than 5 microns; and/or one or more of water, soda, coal dust, alkylesters of orthophosphoric acid, phosphate ester, and alcohol. The LPC may also comprise an aluminum and silicon content of less than 18 parts per million by weight combined; and a particle size of less than 2 microns.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 2A:
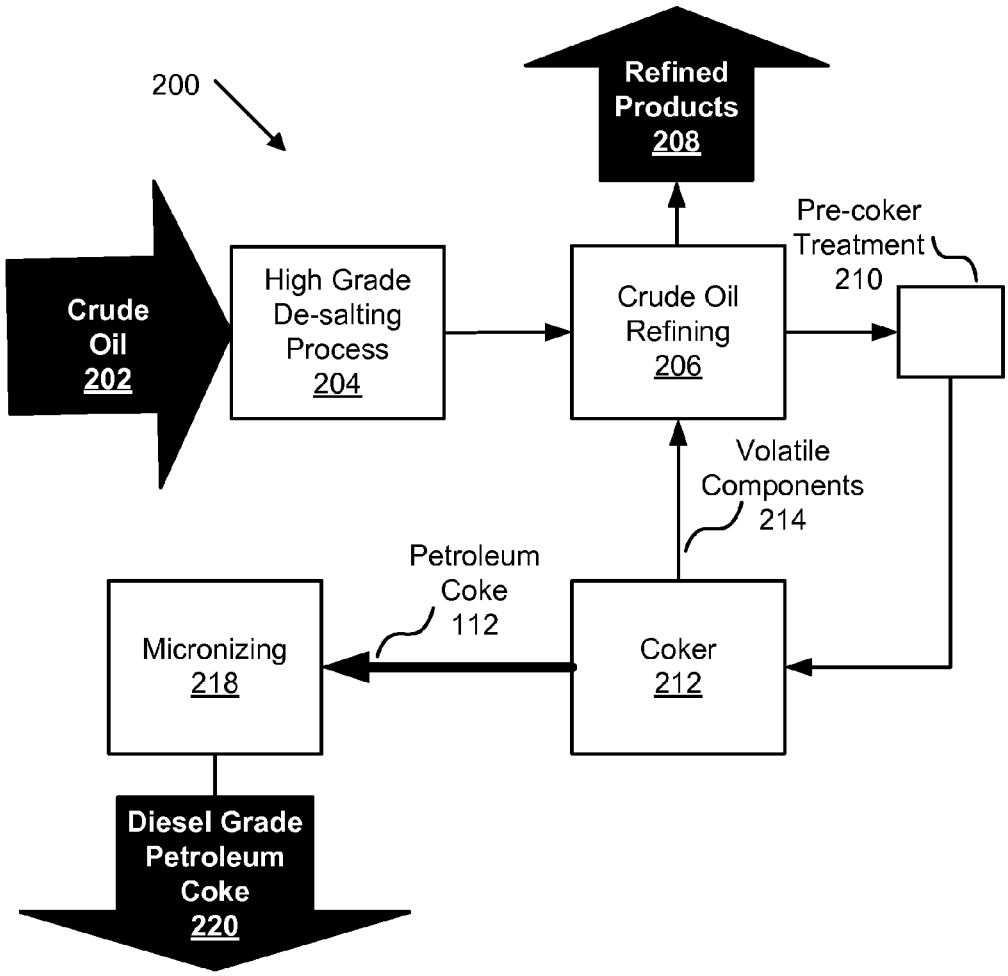
FIG. 2A sets forth a basic process flow diagram for key elements of a pre-coking treatment for crude oil feedstock to create diesel engine fuel grade petroleum coke for fuel for diesel systems in accordance with the present invention.

FIG. 2A sets forth a basic process 200 flow diagram for key elements of a pre-coking treatment for crude oil feedstock to create diesel engine fuel grade petroleum coke for fuel for diesel systems. FIG. 2A comprises crude oil 202, a high grade de-salting process 204, a crude oil refining process 206, refined products 208, a pre-coker treatment 210, a coker 212, volatile components 214, petroleum coke 112, a micronization process 218, and diesel grade petroleum coke 220.

Crude oil 202 is a naturally occurring liquid found in porous rock formations in the upper strata of the Earth's crust comprising various hydrocarbons of differing weights, including alkanes, cycloalkanes, aromatic hydrocarbons and asphaltenes, resulting from apparently biogenic processes. Crude oil 202 further comprises other organic compounds, and is well-known to those of skill in the industry.

Crude oil 202 varies in appearance depending on its composition, from dark brown or black to yellowish or greenish, and may be found in semi-solid form mixed with natural gas and/or saline. Crude oil 202 found is some parts of the world is sour, meaning it contains substantial amounts of sulfur. Crude oil 202 is sweet if it contains relatively little sulfur. For the purposes of this invention and claim interpretation, sour crude oil is crude oil with a higher than average sulfur content for an average barrel of crude oil 202 imported into the United States in 2009, while sweet crude oil is crude oil with a less than average content of sulfur for the average barrel of crude oil 202 imported into the United States in 2009. The teachings of the present invention are particularly applicable to sour crude oil as sour crude generally produces higher amounts of petroleum coke 112 per barrel of crude oil 202 after fractional distillation than does sweet crude oil.

The hydrocarbons of differing weights which form crude oil 202 are separated through a fractional distillation process in an oil refinery to produce butanes 102, kerosene and jet fuel 104, diesel oil 106, fuel oil 108, asphalt 110, and petroleum coke 112. Many of the fractions produced by the fractional distillation process react exothermically with oxygen to power various embodiments of fuel combustion engines well-known to those of skill in the art, including reciprocating two-stroke cycle, four-stroke cycle, six-stroke cycle, diesel engine, and Atkinson cycle engines, as well as rotary engines like the Wankel engine and various gas and jet turbine engines. These engines may have widely different RPM cycles (revolutions per minute), horsepower ratings, and engine volume displacement ratings.

Crude oil 202, in some embodiments, undergoes a high grade de-salting process 204 in accordance with the present invention. In other embodiments, the crude oil 202 does not under a de-salting process 204 before fractional distillation. Operations to remove various water-soluble impurities and suspended solids that are usually present in crude oil 202 from contamination in the ground or in transportation is known as the desalting operation 204, which is well-known to those of skill in the industry.

One or two stages of de-salting units in series are typically used to pre-treat crude oil 202 prior to the atmospheric crude oil distillation columns. One stage of de-salting 204 is common, two stages are typical, but few installations use three or more. The additional stages can increase reliability and obtain additional reduction in the unwanted metals (silicon and aluminum) content of the crude oil 202 and the downstream products from the refining process. Current de-salting technology may be capable of reducing the levels of unwanted metals in the petroleum coke 112 to some degree. Furthermore, the additional stages also provide incremental reductions in other metals (Vanadium, Nickel, and the like) and particulates that promote the unwanted precipitation of shot coke.

Some unwanted contaminants may be introduced to the refinery material prior to coking from refinery streams such as cat cracker slurry. Such streams may contain catalytic material that may have metals that are not wanted in pet coke for processing into diesel engine fuel grade petroleum coke. If such streams can be directed away from coking the downstream processing required will be reduced. Also, additives that may prevent foaming in the coker itself may contain silicon based material that will also add to processing if present.

The preferred embodiment of the present invention uses enough stages of de-salter systems or such design changes to existing de-salter systems as necessary to eliminate the unwanted metals in crude feedstock and potentially uses such treatment of coker feedstock as required such that the refinery can produce the diesel engine fuel grade petroleum coke feedstock that could be used directly in a diesel engine prior to coking or for production of diesel engine grade petroleum coke that is micronized after coking for use in a diesel engine in the most economic manner.

The crude oil refining process 206 comprises a process of subjecting the crude oil 206 to fractional distillation using means well-known to those of skill in the art.

The refined products 208 in the shown embodiment comprise those hydrocarbons resulting from the fractional distillation process excepting the petroleum coke 112, including butanes 102, kerosene and jet fuel 104, diesel oil 106, fuel oil 108, and asphalt 110.

In some embodiments of the present invention, the petroleum coke 112 undergoes a pre-coker treatment 210 in which impurities in the petroleum coke 112 are separated from the petroleum coke 112 with one or more centrifuges. The pre-coker treatment 210 may, in some embodiments, additionally or alternatively comprise a de-salting treatment of the petroleum coke 112 using de-salters designed to withstand high-temperatures in excess of 250 degrees Fahrenheit.

Crude oil 202 is coked in a coker 212. In some embodiments, the crude oil 202 is coked by passing it through de-coking derricks and into coke drums using cokers 212 implementing processes well-known to those of skill in the art, including delayed cokers, fluid cokers, and flexicokers.

The petroleum coke 112 that results from the coking process typically contains contaminants which limit the petroleum coke's 112 effectiveness in commercial applications for which other crude oil fractions are destined.

The typical contaminants of petroleum coke after the fractional distillation processes vary with the specific feedstock and generally by the type of coke produced. Because coke contaminants can vary the processing must be robust enough to handle such variations in impurity content. The following table shows the typical ash characteristics:

TABLE A

Typical Ash Characteristics of Petroleum Coke (% by wt.)

| Ash | Delayed | Shot | Fluid | Flexicoke |
|---|---|---|---|---|
| $SiO_2$ | 10.1 | 13.8 | 23.6 | 1.6 |
| $AlO_3$ | 6.9 | 5.9 | 9.4 | 0.5 |
| $TiO_2$ | 0.2 | 0.3 | 0.4 | 0.1 |
| $FeO_3$ | 5.3 | 4.5 | 31.6 | 2.4 |
| CaO | 2.2 | 3.6 | 8.9 | 2.4 |
| MgO | 0.3 | 0.6 | 0.4 | 0.2 |
| $Na_2O$ | 1.8 | 0.4 | 0.1 | 0.3 |
| $K_2O$ | 0.3 | 0.3 | 1.2 | 0.3 |
| $SO_3$ | 0.8 | 1.6 | 2.0 | 3.0 |
| NiO | 12.0 | 10.2 | 2.9 | 11.4 |
| $V_2O_5$ | 58.2 | 57.0 | 19.7 | 74.5 |
| Typical ash | .72 | .76 | 1.32 | .99 |

Some volatile compounds 214 remaining after coking; and, in some embodiments, these volatile compounds 214 are thermally cracked to shorten the molecular length of the hydrocarbons forming them, and resubmitted to the crude oil reefing process 206. In other embodiments of the present invention, the petroleum coke 112 does not undergo a thermal cracking process before micronization to avoid the introduction of aluminum and silicon impurities to the petroleum coke 112 which impurities can be introduced during thermal cracking.

After distilling and thermally cracking the crude oil 202 in a vacuum distillation column, an atmospheric distillation column, or through other distillation processes well-known to those of skill in the art, portions of the crude oil 202 comprise petroleum coke 112. Petroleum coke 112 comprises the often de-salted, fractionally distilled, thermally cracked and coked crude oil 202. Fuel grade petroleum coke 112, for the purposes of the present invention, may originate in a delayed coker, fluid coker, flexicoker, shot coking unit, or other coker units known to those of skill in the art.

In the present invention, the petroleum coke 112 is subjected to a micronization process 218 in which the petroleum coke 112 is refined into particles of an average size that does not exceed a certain predetermined criterion. In the preferred embodiments, the average particle size of micronized petroleum coke 112 is between 1 and 30 microns. In some embodiments of the present invention, the particle sizes do not exceed 30 microns. In other embodiments, the particle size does not exceed 2 microns. In still further embodiments, the petroleum coke 112 is repeatedly re-micronized in response to the diameter of an average particle of the petroleum coke 112 exceeding a predetermined criterion.

In some embodiments, the predetermined criterion is set by a human operator prior to the fractional distillation process beginning on the crude oil 202. In still further embodiments, the predetermined criterion is automatically determined by a computer analyzing historical data comprising one or more of horsepower output measurements of a specific set of one or more internal combustion engines running on LPC, fuel efficiency ratings for the specific set of internal combustion engines running on LPC, usable lifespan of the specific set of internal combustion engines running on LPC, the amount of impurities in LPC running on the specific set of internal combustion engines, and the average particle sizes of LPC running the specific set of internal combustion engines. The computer may optimize the predetermined criterion by comparing historical data before calculating the predetermined criterion with data gathered after calculating the predetermined criterion.

Diesel engine fuel grade petroleum coke 220 results from micronization process 218 to which the petroleum coke 112 is subjected. As further discussed below in relation to FIG. 2, once subjected to a de-ashing process and a subsequent slurrification process further described below, the diesel engine fuel grade petroleum coke 220 becomes liquefied petroleum coke (LPC).

Figure 2B:
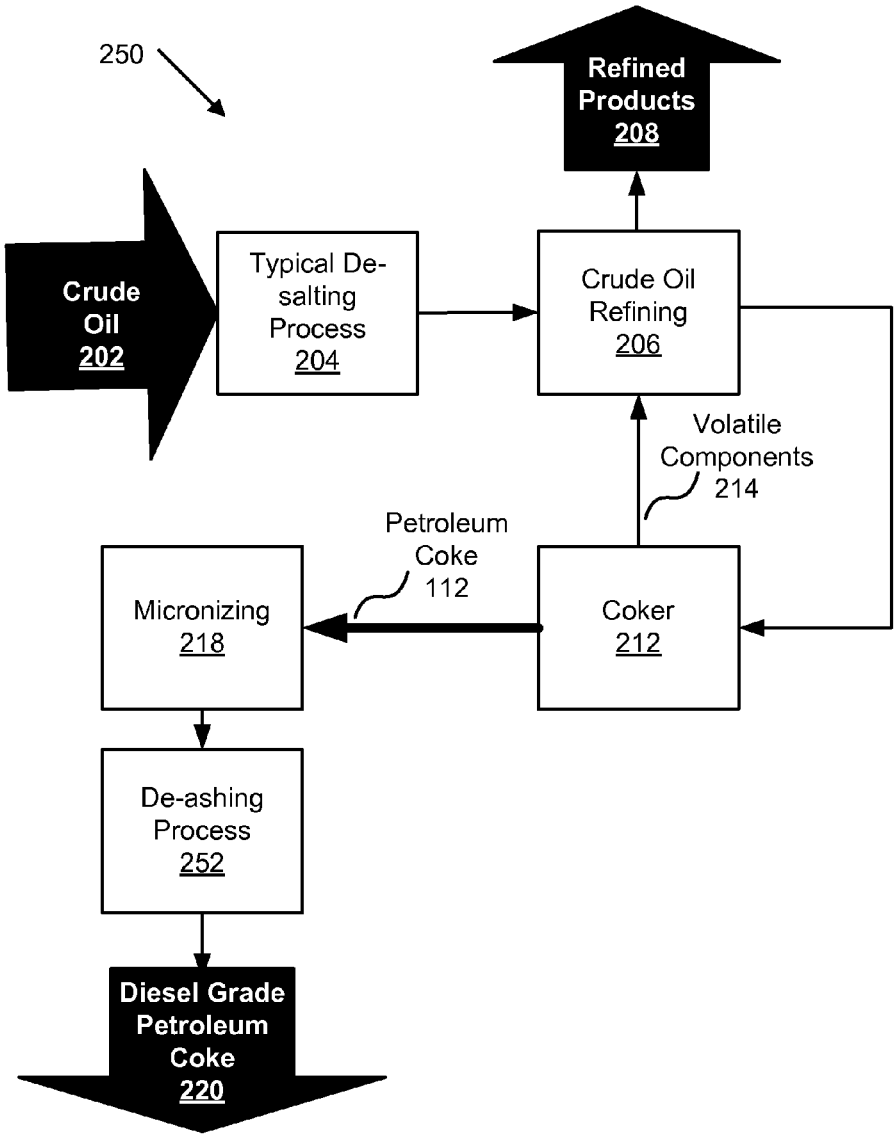
FIG. 2B sets forth a basic process flow diagram for a conventional coke production system with post coke production treatment to create diesel engine fuel grade petroleum coke for fueling diesel engine systems in accordance with the present invention.

Petroleum coke 112 may be fuel grade or anode grade. Fuel grade petroleum coke is high in sulfur content as well as the content of other heavy metals like silicon and aluminum, while anode grade petroleum coke 112 is low in sulfur and other metals. Anode grade petroleum coke 112 is traditionally used in the aluminum and steel industries and thought to be of little value for use in internal combustion engines. It is the object of the present invention to, inter alia, teach new processes of de-ashing, micronizing and slurrificating fuel grade petroleum coke such that the petroleum coke 112 becomes useful in internal combustion engines like diesel engines, including large displacement, low-speed diesel and medium-speed diesel engines used for marine propulsion and stationary power generation. Other embodiments of the present invention may be useful in variations of the internal combustion engine, including reciprocating two-stroke cycle, four-stroke cycle, six-stroke cycle, and Atkinson cycle engines, as well as rotary engines like the Wankel engine and various gas and jet turbine engines Referring now to FIG. 2B, a basic process 250 flow diagram for a conventional coke production system with post coke production treatment to create diesel engine fuel grade petroleum coke for fueling diesel engine systems. FIG. 2B comprises crude oil 202, a high grade de-salting process 204, a crude oil refining process 206, refined products 208, a coker 212, volatile components 214, petroleum coke 112, a micronization process 218, a de-ashing process 252, and diesel grade petroleum coke 254.

Figure 1:
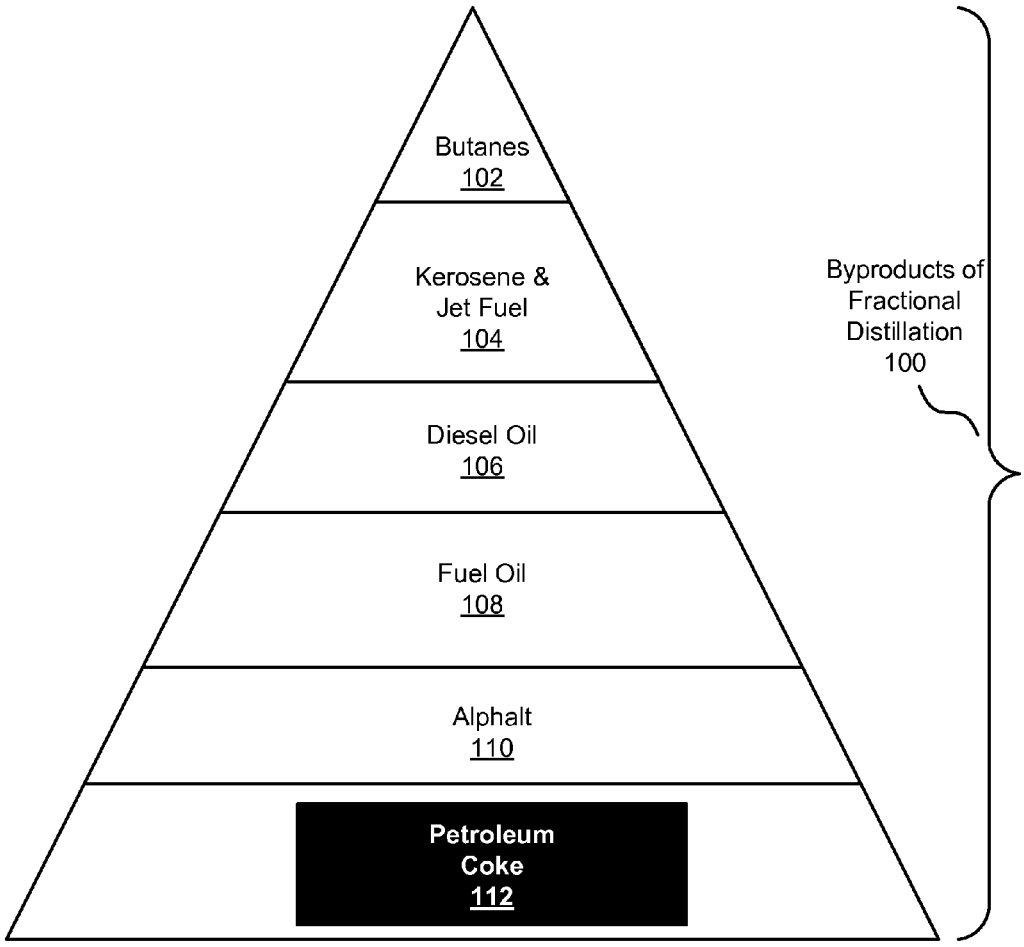
Fig. 1 (Prior Art)
FIG. 1 sets forth a block diagram showing the fractionals produced by a fractional distillation process applied to crude oil in oil refineries.

Crude oil 202 is substantially described above in relation to FIGS. 1-2A.

The high grade de-salting process 204 is substantially described above in relation to FIGS. 1-2A.

The crude oil refining process is substantially described above in relation to FIGS. 1-2A.

The refined products 208 are substantially described above in relation to FIGS. 1-2A.

The pre-coker treatment 210 is substantially described above in relation to FIGS. 1-2A.

A coker 212 is substantially described above in relation to FIGS. 1-2A.

The volatile components 214 are substantially described above in relation to FIGS. 1-2A.

The petroleum coke 112 substantially described above in relation to FIGS. 1-2A.

The de-ashing process 252 comprises a process of removing contaminants, including heavy metals, from the petroleum coke 112. Typical de-ashing processes 252 are well-known to those of skill in the art. The de-ashing process involves applying solvent extraction methods common to metals extraction processes from ore and those processes used to prepare anode grade coke. In such processes the main ash components such as SiO2 and Al2O3 can be removed from the micronized pet coke using a pressurized and elevated temperature caustic leach (NaOH) to covert impurities to sodalite type materials that can then be further processed with acids such as H2SO4. The resultant materials can then be removed by filtration. Alternative high temperature processes can remove mineral impurities by heating to very high temperature in excess of 2500 deg. Celsius. Treatment with 63.5% nitric acid for a period of time has been shown to also remove unwanted impurities at a temperature of 100 deg. C. These methods will be employed based on the specific coke product and its degree of contamination.

Diesel grade petroleum coke 220 is substantially described above in relation to FIGS. 1-2A.

Figure 2C:
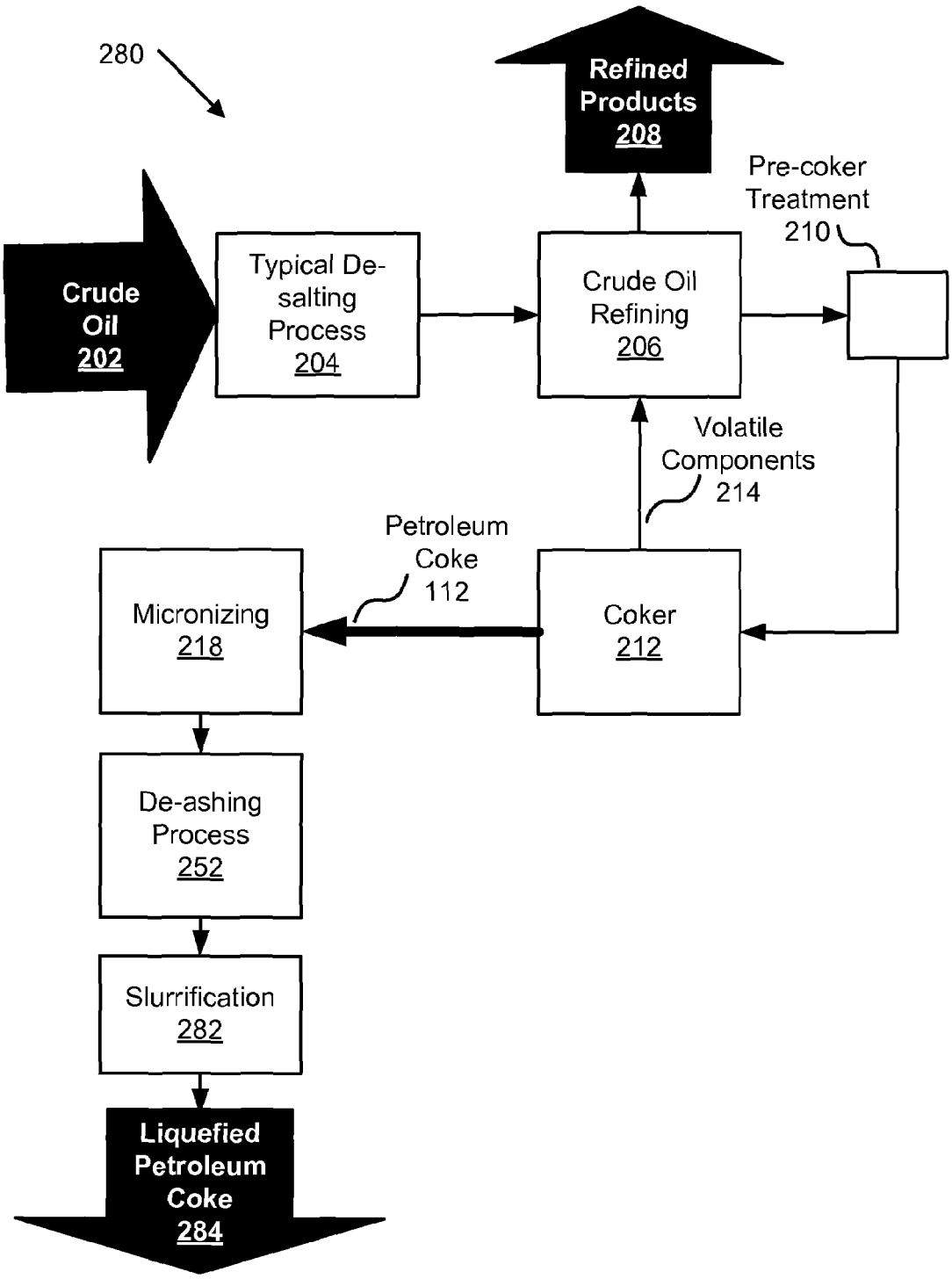
FIG. 2C sets forth a basic process flow diagram for a coke production system with coke processing to create liquefied petroleum coke (LPC) in accordance with the present invention.

Referring now to FIG. 2C, a basic process flow diagram for a coke production system with coke processing to create liquefied petroleum coke (LPC) in accordance with the present invention. FIG. 2C comprises crude oil 202, a high grade de-salting process 204, a crude oil refining process 206, refined products 208, a pre-coker treatment 210, a coker 212, volatile components 214, petroleum coke 112, a micronization process 218, a de-ashing process 252, a slurrification process 282, and liquefied petroleum coke 282.

Each of the crude oil 202, the high grade de-salting process 204, the crude oil refining process 206, the refined products 208, the pre-coker treatment 210, the coker 212, the volatile components 214, the petroleum coke 112, the micronization process 218, and the de-ashing process 252 are substantially described above in relation to FIGS. 1-2B.

In the slurrification process 282 (also interchangeably referred to as the slurrifying process herein), the diesel grade petroleum coke 220 is combined with one or more of one or more of water, soda, coal dust, alkylesters of orthophosphoric acid, phosphate ester, and alcohol, producing liquefied petroleum coke (LPC) 284.

The preferred embodiment of the present invention is to produce a diesel engine fuel grade petroleum coke 220 which can be made into slurry (resulting in LPC) which is suitable as a fuel in stationary two-stroke low speed uni-flow scavenged diesel engines operating at speeds between 45 and 250 revolutions per minute. A further advantageous embodiment of this invention is to produce a diesel engine fuel grade petroleum coke 220 which can be made into slurry which is suitable as a fuel in stationary four-stroke medium speed diesel engines operating at speeds between 250 and 950 revolutions per minute. Specifically, the teachings of the present invention may be applied to power MAN B&W two-stroke, low speed, crosshead, uniflow scavenged diesel engines. In yet another embodiment, the present invention may used as a fuel in a stationary, gas turbine combustion system.

For the purposes of this invention the term "liquefied petroleum coke" 184, or LPC 184, comprises fuel grade petroleum coke subjected to a de-ashing process and micronization process to produce diesel engine fuel grade petroleum coke 110, also referred to as diesel grade petroleum coke 220. The diesel grade petroleum coke 220 is subsequently made into a slurry suitable for use in internal combustion engines.

LPC 284 is a new product derived from fuel grade petroleum coke 112 which, in the preferred embodiment, has properties that makes it suitable as a fuel in internal combustion engines. One embodiment of the present invention requires that the fuel grade petroleum coke 112 be de-ashed to less than 18 PPM/weight of silicon and aluminum combined and micronized to a maximum particle size of 2 microns and made into a slurry by combining it with one or more of water, soda, coal dust, alkylesters of orthophosphoric acid, phosphate ester, and alcohol to produce a non-Newtonian micro-fluid. Other additives may also be combined with the LPC 284 to improve performance in specific internal combustion applications. After slurrification, LPC 284 comprises a micro-fluid with an apparent equivalent viscosity of between 10 and 20 centiStokes found in a Newtonian fluid. In other embodiments, LPC 284 has slightly deviating properties as further described herein.

Figure 3:
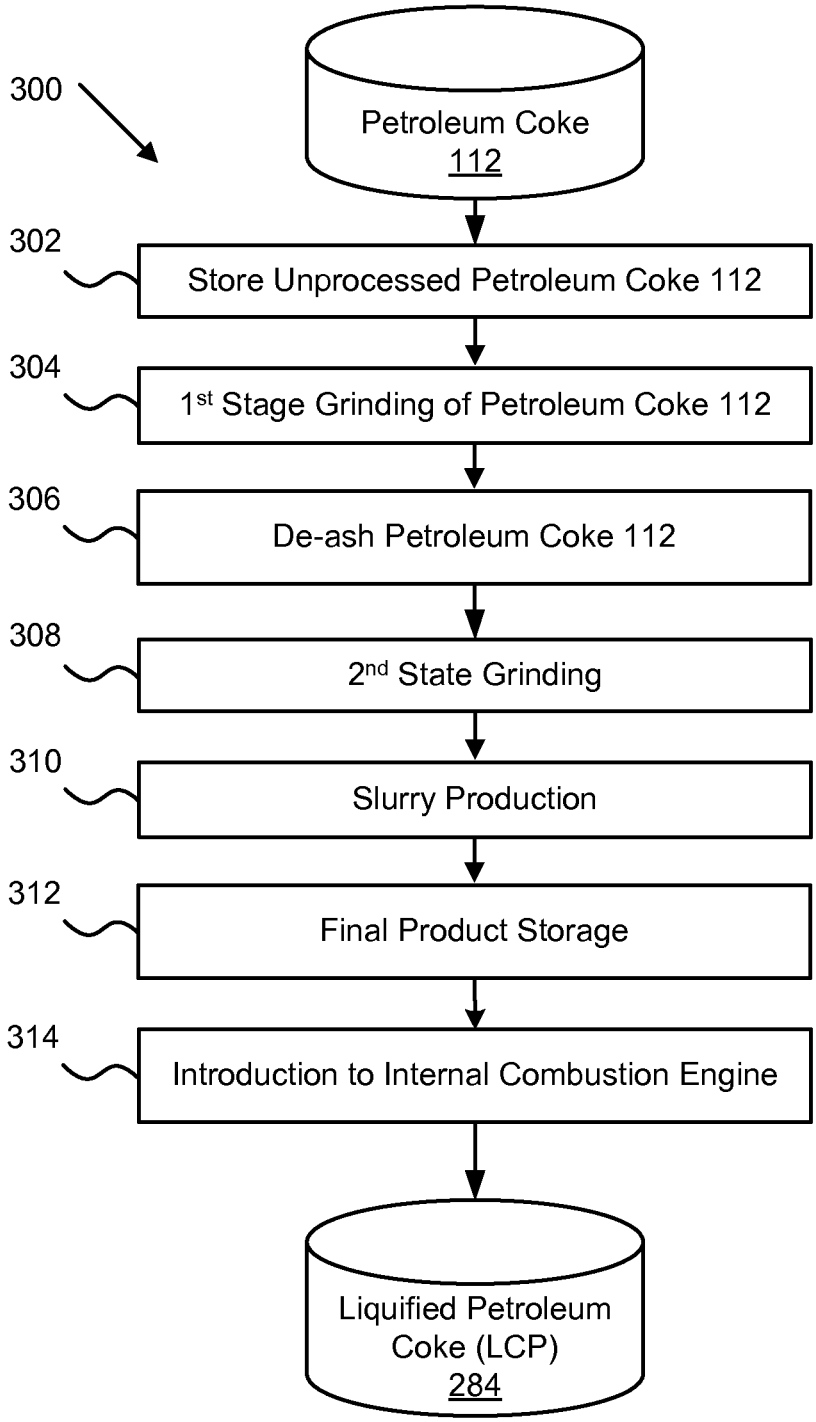
FIG. 3 is a flow chart of a method of processing petroleum coke for use in fuel combustion engines in accordance with the present invention.

Referring now to FIG. 3, a flow chart of a method 300 of processing petroleum coke for use in internal combustion engines in accordance with the present invention. FIG. 3 depicts one embodiment of a method of producing LPC 284 from petroleum coke 112.

The method begins 302 when unprocessed fuel grade petroleum coke 112, also called green coke, in stored and prepared for a first stage grinding process which takes place 304. The petroleum coke 112 is ground into fine particles of an average particle size that does not exceed twenty (20) microns in the shown embodiment.

In this embodiment of the method 300, the fuel grade petroleum coke 112 is de-ashed 306 using methods well-known to those of skill in the art. In other embodiments of the method 300, the petroleum coke 112 may be de-ashed 306 using other processes taught in the present invention or well-known to those of skill in the art.

After the second state of grinding 308, the petroleum coke 112 enters slurrification production state 310 in which the ground fuel grade petroleum coke 112 is combined with water and one or more of water, soda, coal dust, alkylesters of orthophosphoric acid, phosphate ester, and alcohol to produce a petroleum coke slurry which comprises a micro-fluid. The slurry is LPC 284. Other additives may also be combined with the LPC 284 to improve performance in specific internal combustion applications.

The LPC 284 to be used by the internal combustion engine system may be up to 80% micronized processed pet coke by weight. A slurry fuel can be stored in existing tank type storage systems and use piping systems that are common for diesel engine systems. Some diesel engines may require some fuel oil as pilot fuel or as an additive to the slurry in order to prevent the LPC 284 causing cavitation in mechanical fuel injection systems commonly found in large displacement, low- and medium-speed diesel engines, therefore, in certain embodiments of the present invention, LPC may further comprise fuel oil.

The LPC 284 is stored 312 before finally being introduced into an internal combustion engine 314 in accordance with the present invention. In some embodiments of the method 300, the LPC 284 is introduced in a pressured state to improve performance of the internal combustion engine. In still further embodiments, the LPC 284 is combined one before, or upon, introduction into the internal combustion engine with other performance improving additives.

The purpose of the embodiment shown in FIG. 3 is to illustrate that LPC 284 is more than fuel grade petroleum coke 112, but rather is fuel grade petroleum coke 112 that has been micronized 412-416; de-ashed 252, and slurrified 310 to comprise a micro-fluid.

Figure 4:
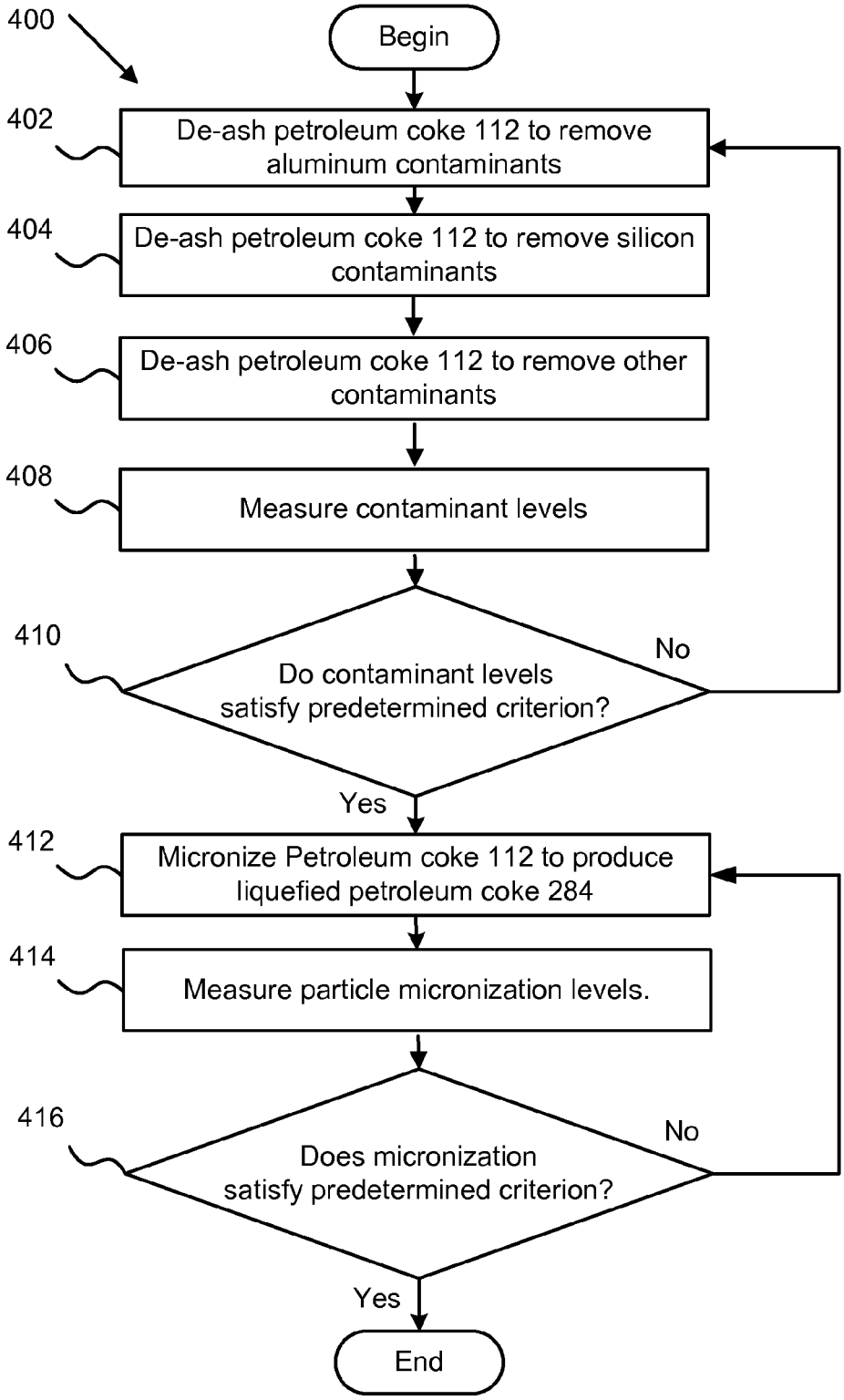
FIG. 4 is a flow chart of an alternate method of processing petroleum coke for use in fuel combustion engines in accordance with the present invention.

Referring now to FIG. 4, a flow chart of an alternate method 400 of processing fuel grade petroleum coke for use in internal combustion engines in accordance with the present invention.

In the shown embodiment, contaminant levels of impurities including, but not limited to, silicon and aluminum are measured during the method 400 to determine whether or not those impurities exceed a predetermined criterion. In the shown embodiment, if these impurities do exceed a predetermined criterion, the petroleum coke 112 is subjected to a subsequent round of de-ashing processes 402-406.

Furthermore, in the shown embodiment, the average particle size of petroleum coke 112 is measured to determine whether it exceeds or satisfied a pre-determined criterion. If the average particle size satisfies the predetermined criterion, the method 400 proceeds to conclusion in the shown embodiment. In other embodiments, the LPC 284 resulting from the method 400 may be introduced in accordance with the present invention to an internal combustion engine.

In unshown embodiments of the present invention, existing diesel engines designed to be fueled by conventional fuels such as distillate oil or heavy fuel oil may be converted to be fueled by LPC 284 after being retrofit to run on LPC 284. In various unshown embodiments, low-speed diesel engines may be retrofit by replacing fuel injection pump units with units designed to handle the volume of LPC 284 required to combust the amount of thermal energy the engine was designed for.

New and existing diesel engines designed to be fueled by conventional fuels such as gaseous fuels, distillate oil or heavy fuel oil may be converted to be fueled by LPC 284 provided they are retrofit.

In some embodiments, fuel injection pumps are replaced or retrofit with units designed to handle the volume of LPC 284 required to be injected to provide the thermal energy equivalent of the gaseous fuel, distillate oil or heavy fuel oil the engine was designed for combusting to maintain the same mechanical power output.

In some embodiments, fuel injectors are replaced or retrofit with units designed to handle the volume of LPC 284 required to combust the amount of thermal energy the engine was designed for the thermal energy equivalent of the gaseous fuel, distillate oil or heavy fuel oil the engine was designed for combusting to maintain the same mechanical power output.

In some embodiments, common rail injection components are replaced or retrofit which are designed to handle the volume of LPC 284 required to be injected to provide the thermal energy equivalent of the distillate oil or heavy fuel oil the engine was designed for combusting to maintain the same mechanical power output.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of producing liquefied petroleum coke (LPC) from fuel grade petroleum coke, the steps of the method comprising:

de-ashing the fuel grade petroleum coke to reduce its silicon and aluminum content;

micronizing the petroleum coke such that its particles average less than 20 microns in size; and slurrying the petroleum coke to comprise a micro-fluid with an apparent equivalent Newtonian fluid viscosity of between 10 and 20 centiStokes.

2. The method of claim 1, further comprising a step of de-salting a unit of crude oil using de-salting units in series such that the de-saltation process reduces the prevalence of one or more heavy metals in the unit of crude oil.

3. The method of claim 1, further comprising a step of further reducing the prevalence of heavy metals in coker feed-streams by using one or more of centrifugal separating units and de-salting units capable of tolerating temperatures in excess of 250 degrees Fahrenheit.

4. The method of claim 1, wherein the de-ashing step takes place after the micronizing step but before the slurrying process and reduces the sulfur and aluminum content of the coker feed-steam such that the resulting fuel grade petroleum coke produced comprises less than 80 parts per million of aluminum and silicon combined.

5. The method of claim 1, where in the de-ashing step takes place after the micronizing step but before the slurrying process and reduces the sulfur and aluminum content of the coker feed-steam such that the resulting fuel grade petroleum coke produced comprises less than 18 parts per million of aluminum and silicon combined.

6. The method of claim 1, where in the de-ashing step takes place after the slurrying step and reduces the sulfur and aluminum content of the fuel grade petroleum coke such that the fuel grade petroleum coke comprises less than 80 parts per million of aluminum and silicon combined.

7. The method of claim 1, where in the de-ashing step takes place after the slurrying step and reduces the sulfur and aluminum content of the fuel grade petroleum coke such that the fuel grade petroleum coke comprises less than 18 parts per million of aluminum and silicon combined.

8. The method of claim 1, wherein the fuel grade petroleum coke is micronized to an average particle size of between 2 and 5 microns.

9. The method of claim 1, wherein the fuel grade petroleum coke is micronized to a particle size of less than 2 microns.

10. The method of claim 1, wherein the fuel grade petroleum coke is subjected to subsequent de-ashing steps in response to the measured amounts of aluminum and silicon in the petroleum coke exceeding a predetermined criterion.

11. The method of claim 1, wherein the average diameter of a particle of the fuel grade petroleum coke is measured after micronization and the fuel grade petroleum coke is re-micronized if it is found to have an average particle size that exceeds a predetermined criterion.

12. The method according to claim 10 or claim 11, wherein a computer automatically calculates the predetermined criterion by analyzing historical data comprising one or more of horsepower output measurements for a specific set of one or more internal combustion engines running on LPC, fuel efficiency ratings for the specific set of internal combustion engines running on LPC, useable lifespan of the specific set of internal combustion engines running on LPC, the amount of impurities in LPC running on the specific set of internal combustion engines, and the average particle sizes of LPC running the specific set of internal combustion engines.

13. The method of claim 1, wherein the slurrying step further comprises combining the micronized fuel grade petroleum coke with one or more of water, soda, coal dust, alkylesters of orthophosphoric acid, phosphate ester, and alcohol to produce a petroleum coke slurry.

14. A method of powering an engine according to claim 1, further comprising a step of using the liquefied petroleum coke (LPC) as a fuel in an engine selected from the group consisting of two-stroke low-speed diesel engines with an RPM range of between 45 and 250 revolutions per minute, four-stroke medium-speed diesel engines with an RPM range of between 250 and 950 revolutions per minute, and stationary gas turbines.

15. A liquefied petroleum coke (LPC) product made in accordance with the method according to claim 1.

16. The LPC product of claim 15, wherein the LPC comprises:

an aluminum and silicon content of less than 80 parts per million combined; and an average particle size of less than 20 microns.

17. The LPC product of claim 15, wherein the LPC comprises:

an aluminum and silicon content of less than 18 parts per million by weight combined; and an average particle size of less than 5 microns.

18. The LPC product of claim 15, wherein the LPC further comprises one or more of water, soda, coal dust, alkylesters of orthophosphoric acid, phosphate ester, and alcohol.

19. The LPC product of claim 15, wherein the LPC comprises:

an aluminum and silicon content of less than 18 parts per million by weight combined; and a particle size of less than 2 microns.

* * * * *